US006241560B1

(12) United States Patent
Furusawa et al.

(10) Patent No.: US 6,241,560 B1
(45) Date of Patent: Jun. 5, 2001

(54) ELECTRIC CONNECTOR HAVING DEPRESSIBLE CONTACT PIECES CAPABLE OF CONVEYING A RELATIVELY LARGE CURRENT

(75) Inventors: Sadatoshi Furusawa; Kinzo Narumo; Kenichi Takahashi, all of Tokyo (JP)

(73) Assignee: Honda Tsushin Kogyo Co., Ltd., Tokyo (JP)

( * ) Notice: Subject to any disclaimer, the term of this patent is extended or adjusted under 35 U.S.C. 154(b) by 0 days.

(21) Appl. No.: 09/368,902

(22) Filed: Aug. 6, 1999

(30) Foreign Application Priority Data

May 12, 1999 (JP) ..... 11-131228

(51) Int. Cl.[7] ..... H01R 13/24
(52) U.S. Cl. ..... 439/700
(58) Field of Search ..... 439/289, 700, 439/824

(56) References Cited

U.S. PATENT DOCUMENTS 2,798,125 * 7/1957 Zink, Jr. .
4,636,026 * 1/1987 Cooney et al. .
4,838,801 * 6/1989 Bertoglio et al. ..... 439/83
5,576,675 * 11/1996 Oldfield ..... 439/578

* cited by examiner

*Primary Examiner*—Khiem Nguyen
(74) *Attorney, Agent, or Firm*—Arent Fox Kintner Plotkin & Kahn

(57) ABSTRACT

Disclosed is an improved electric connector having depressible probe pins each comprising movable and stationary contact pieces. The movable contact piece comprises a front projection and a rear convergence integrally connected to the front projection. The probe pin is press-fitted in a selected pin slot in the insulating casing of the electric connector, allowing the front projection to partly appear from the selected pin slot. The stationary contact piece has two opposite arms extending from its base. The opposite arms of the stationary contact piece pinch the convergence of the movable contact piece, and withdrawal of the front projection of the movable contact piece causes the opposite arms to yieldingly open wide enough to allow the convergence of the movable contact piece to invade therebetween. The parallel-arrangement of current-carrying passages provided by the bifurcate stationary contact piece has the effect of increasing the current conducting capacity of the electric connector.

7 Claims, 4 Drawing Sheets

ELECTRIC CONNECTOR HAVING DEPRESSIBLE CONTACT PIECES CAPABLE OF CONVEYING A RELATIVELY LARGE CURRENT

BACKGROUND OF THE INVENTION

1. Field of the Invention

The present invention relates to a male or female type of electric connector, and more particularly to an electric connector having depressible probe pins mounted in its insulating casing, the depressible probe pins being yieldingly depressed in the pin slots of the insulating casing when pushed against the contacts of a counter electric connector.

2. Related Arts

Referring to FIG. 10, a conventional pin-depressible type of male or female connector 23 comprises an insulating casing 20 having a plurality of contact pin slots 21 made therein and a corresponding plurality of probe pins 22 inserted in the contact pin slots 21 of the insulating casing 20. Each probe pin 22 comprises a movable contact piece 22*a* and a stationary contact piece 22*b* integrally connected to the movable contact piece 22*a* via a zigzag spring 22*c*. Specifically the movable contact piece 22*a* appears partly from the contact pin slot 21, and is responsive to abutment on a counter contact (not shown) for yieldingly withdrawing in the contact pin slot 21, compressing the zigzag spring 22*c* to make a required electric connection between the probe pin 22 and the counter contact. The stationary contact piece 22*b* is in the form of square base, and is fixedly caught by the inner wall of the contact pin slot 21 when press-fitted therein.

Referring to FIG. 11, another conventional pin-depressible type of connector 24 has a depressible spring-biased probe pin 24*b* partly appearing from its cylindrical sleeve 24*a*.

Disadvantageously the former depressible type of connector 23 has an increased electric resistance, and therefore it cannot permit a relatively large current to flow therethrough. As for the latter depressible type of connector 24 the coiled spring and sleeve prevent the connector size from being reduced below certain limits. Also, disadvantageously it cannot be produced without recourse to machining, and accordingly the cost involved for manufacturing is high.

SUMMARY OF THE INVENTION

One object of the present invention is to provide a depressible type of electric connector which is free of such defects as described above.

To attain this object an electric connector comprising an insulating casing having a plurality of contact pin slots made therein and a corresponding plurality of probe pins inserted in the contact pin slots of the insulating casing, is improved according to the present invention in that each of the probe pins comprises: a movable contact piece having a front projection and a rear convergence integrally connected to the front projection; and a stationary bifurcate contact piece having two contact arms extending from its base, whereby when the front projection of each probe pin appearing from the contact pin slot is pushed against a selected counter contact, the front projection of the probe pin is withdrawn in the contact pin slot to allow the rear convergence of the probe pin to invade the space defined between the two arms of the stationary bifurcate contact piece by yieldingly bending the opposite arms outward.

The stationary bifurcate contact piece may comprise further a detent extension projecting from its base for preventing invasion of the rear convergence beyond a certain limit.

The rear convergence of the movable contact piece may be integrally connected to the base of the stationary bifurcate contact piece by a resilient member.

The connector structure according to the present invention is simple, still assuring that a reliable electric connection be made between the movable and stationary parts thanks to invasion of the convergence of the movable piece into the bifurcate stationary piece, and at the same time, significantly increasing the current-carrying capacity thanks to use of the bifurcate shape of stationary part. These parts can be produced by stamping them from thin metal sheets. Accordingly the number of manufacturing steps, and hence the manufacturing cost can be substantially reduced.

Excessive invasion into the bifurcate stationary part can be effectively prevented by detent means, still permitting smooth withdrawal of the movable part.

Other objects and advantages of the present invention will be understood from the following description of depressible type of electric connectors according to preferred embodiments of the present invention, which are shown in accompanying drawings.

DETAILED DESCRIPTION OF PREFERRED EMBODIMENT

Figure 1:
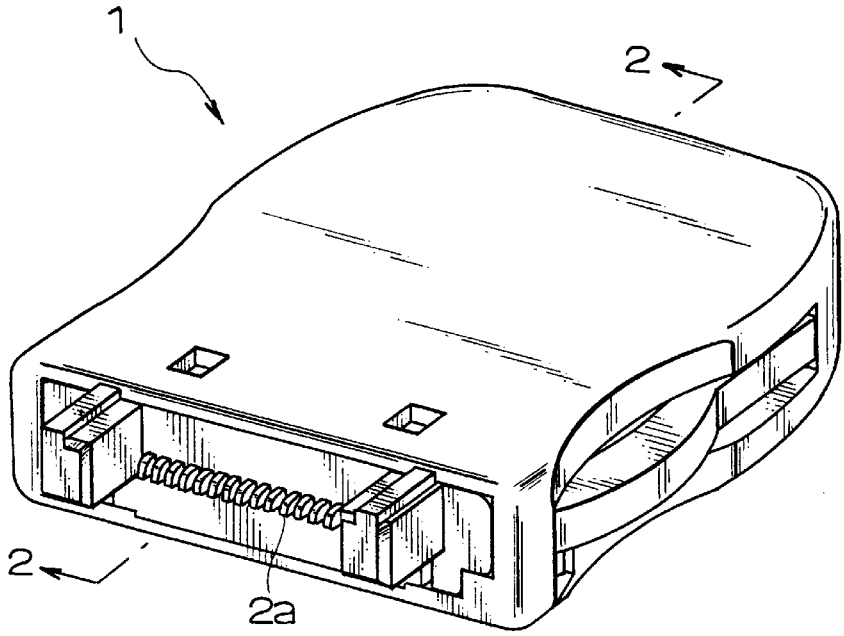
FIG. 1 is a perspective view of a depressible type of electric connector according to a first embodiment of the present invention.
Figure 2:
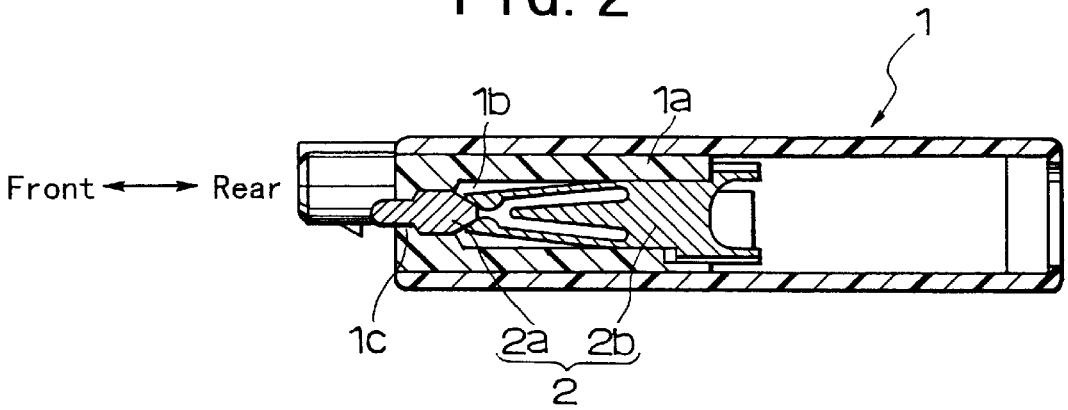
FIG. 2 is a longitudinal section of the electric connector taken along the line 2—2 in FIG. 1.

Referring to FIGS. 1 and 2, an electric connector according to the first embodiment of the present invention is of female type. It comprises an insulating casing 1*a* having a plurality of contact pin slots 1*b* made therein and a corresponding plurality of probe pins 2 inserted in the contact pin slots 1*b* of the insulating casing. Each probe pin 2 is composed of a movable contact piece 2*a* and a stationary contact piece 2*b*.

Figure 3:
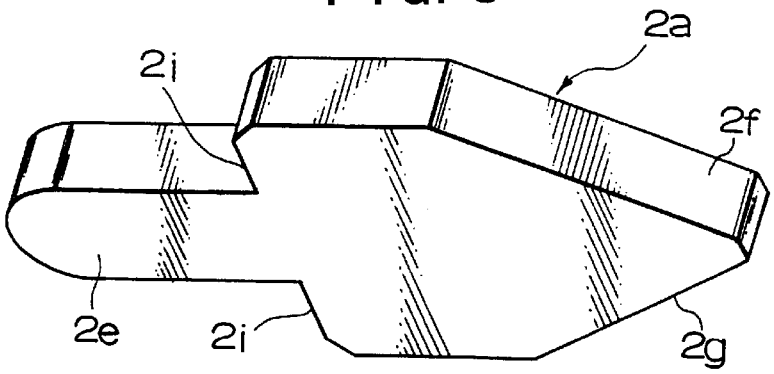
FIG. 3 is a perspective view of a movable contact piece used in the first embodiment of the present invention.

The probe pin 2 is made by stamping it from thin metal sheets (for instance, about 0.2 mm thick) with a metal die. As seen from FIGS. 2 and 3, the movable contact 2*a* comprises a front projection 2*e* and a rear convergence integrally connected to the front projection 2*e*. The front projection 2*e* of the movable contact 2*a* partly appears from one end opening lc of the pin slot 1*b* so that it may abuts against a counter contact such as a male contact 3*a* in FIGS. 5A and 5B. The rear convergence of the movable contact 2*a* is triangular in shape, and its tapering sides 2*f* and 2*g* converge to one common point. The movable contact 2*a* has shoulders 2*i* formed on its opposite front projection-to-rear convergence transitions, thereby preventing the movable contact 2*a* from slipping off from the opening 1*c* of the pin slot 1*b*.

Figure 4:
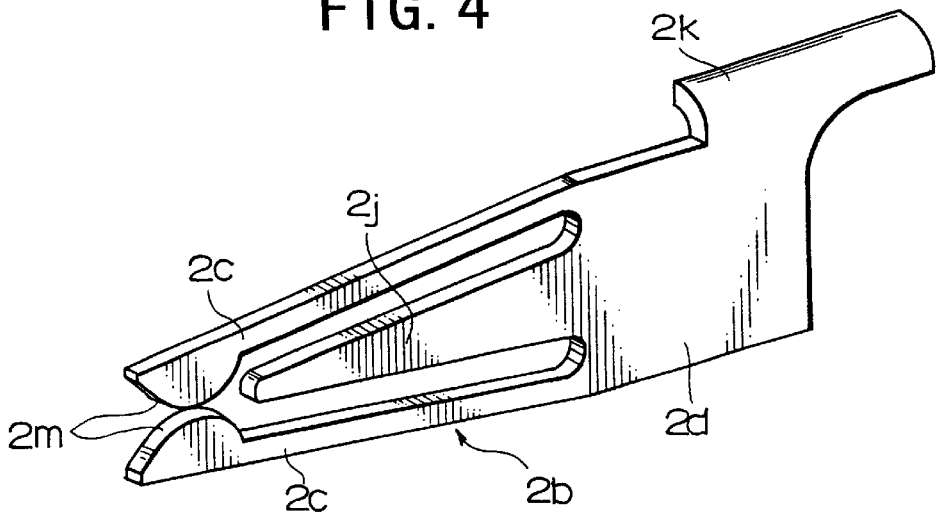
FIG. 4 is a perspective view of a stationary contact piece used in the first embodiment of the present invention.

Likewise, the stationary bifurcate contact piece 2*b* is made by stamping it from thin metal sheets as shown in FIGS. 2 and 4. It has two contact arms 2*c* and 2*c* extending from its base 2*d*. In this particular example the two contact arms converge toward one common point. Each of the opposite arms 2*c* and 2*c* has a semicircular bulge 2*m* formed on its end, so that the opposite arms may be expanded wide enough to allow the convergence sides 2*g* and 2*f* to invade between the opposite arms 2*c* and 2*c* while removing dusts, if any from the convergence of the movable contact 2*a*. Thus, the converging contact arms 2*c* and 2*c* function as a dust remover or wiper.

As shown, the stationary contact 2*b* has a longitudinal detent extension 2*j* projecting from its base 2*d*, reaching short of the bulged ends 2*m* and 2*m* of the opposite arms 2*c* and 2*c*.

The base 2*d* has a terminal section 2*k* formed on one side. The terminal section 2*k* takes a role of putting the stationary contact 2*b* in position in press-fitting a selected pin slot 1*b*. The stationary contact 2*b* has its terminal section 2*k* formed vertically in staggered relation with adjacent stationary contacts 2*b*, thereby decreasing the terminal-to-terminal interval to possible minimum.

Figure 5A:
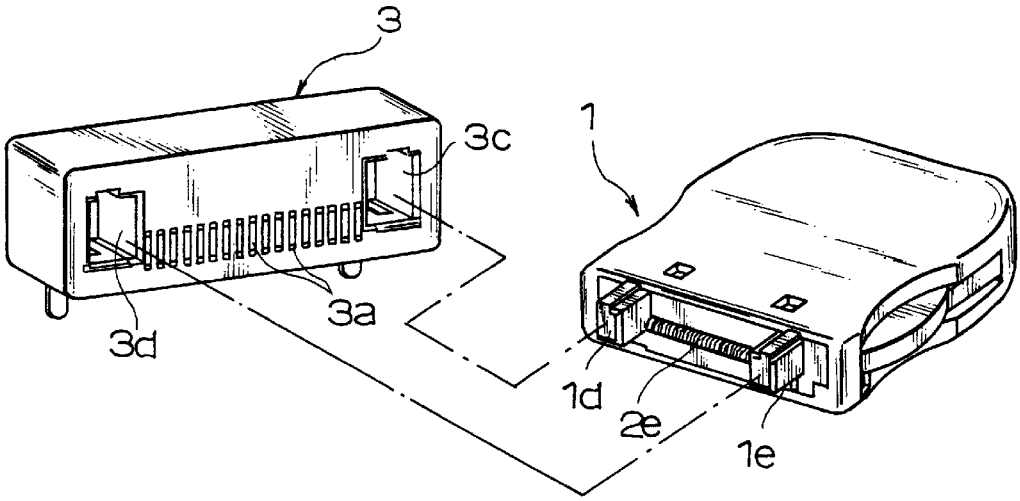
FIG. 5A illustrates how the electric connector of the first embodiment is mated with a counter electric connector.
Figure 5B:
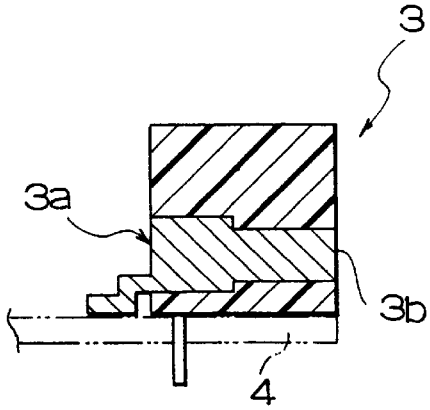
FIG. 5B shows, in section, the counter male connector.

Referring to FIG. 5A such probe pins 2 are press-fitted in the pin slots 1*b* of the female connector casing 1*a*, and the female connector 1 can be met with a counter male connector 3, which is fixed to a printed circuit board 4, as seen from FIG. 5B. Specifically the male and female connectors 3 and 1 can be coupled by press-fitting the opposite male projections 1*d* and 1*e* of the female connector 1 in the opposite female recesses 3*c* and 3*d* of the male connector 3.

Figure 6A:
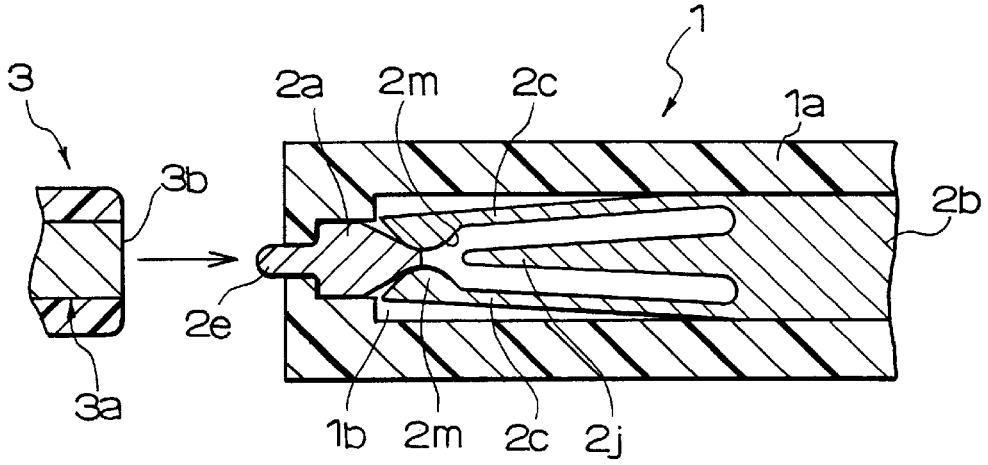
FIGS. 6A and 6B show, in section, how the electric connector of the first embodiment is mated with the counter electric connector.
Figure 6B:
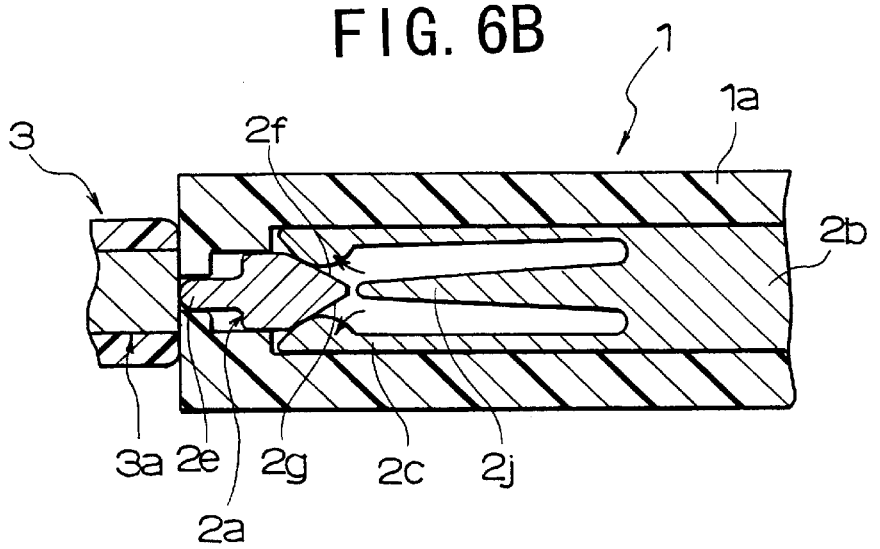

When the male and female connectors 3 and 1 are coupled together, the front projections 2*e* of the movable contacts 2*a* abut against the end faces 3*b* of the male contacts 3*a* in the male connector 3 (see FIG. 5B) to make the movable contacts 2*a* to withdraw in the pin slots 1*b* of the female connector 3 while allowing the convergence of the movable contacts 2*a* to invade between the opposite arms 2*c* and 2*c* of the bifurcate stationary contact pieces 2*b*, expanding them wide as indicated by arrows in FIG. 6B. It should be noted that between each arm 2*c* of the bifurcate stationary contact piece 2*b* and the inner wall of each pin slot 1*b* there remain gaps large enough to allow the opposite arms 2*c* to bend outward.

Thus, the tapered sides 2*f* and 2*g* of the convergence of each movable contact 2*a* are pinched between the bulged ends 2*m* of the opposite arms 2*c* to make a reliable electric connection. The bifurcate stationary contact piece 2*b* provides a parallel-arrangement of current carrying passages so that an increased quantity of electric current may flow therethrough.

The movable contact piece 2*a* stops when it abuts against the detent extension 2*j*, thus preventing the movable contact piece 2*a* from withdrawing deep too much in the pin slot 1*b*.

Figure 7:
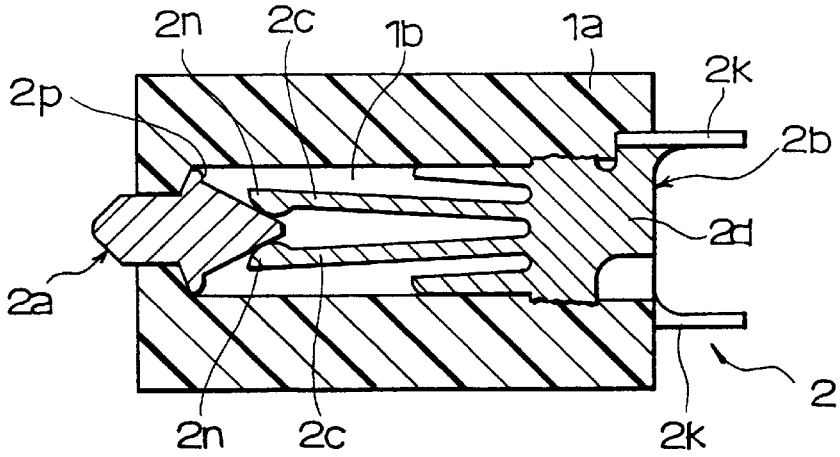
FIG. 7 shows, in section, an electric connector according to a second embodiment.

Referring to FIG. 7, an electric connector according to the second embodiment of the present invention is different only in that each movable contact piece 2*a* has shoulders 2*p* formed at the front projection-to-rear convergence transitions in place of the detent extension. The ends 2*n* of the opposite arms 2*c* of the bifurcate stationary contact piece 2*b* abut against the opposite shoulders 2*p* of the movable contact piece 2*a*, thereby preventing the movable contact piece 2*a* from invading deep too much in the pin slot 1*b*. The bifurcate stationary contact piece 2*b* provides a parallel-arrangement of current carrying passages so that an increased current may flow therethrough.

Figure 8:
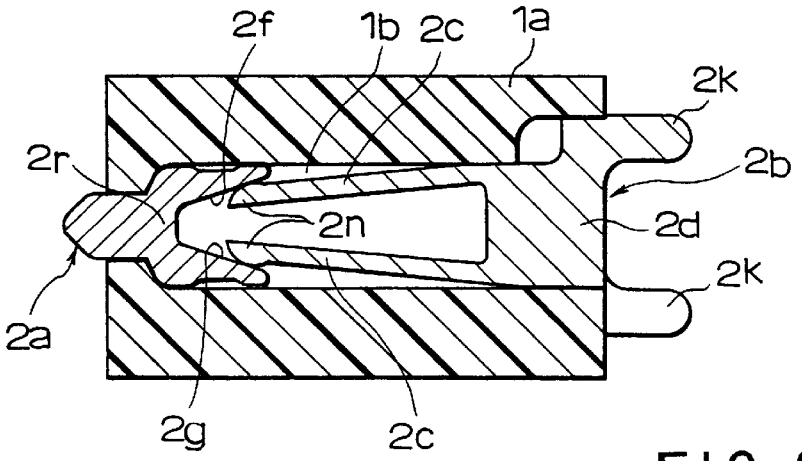
FIG. 8 shows, in section, an electric connector according to a third embodiment.

Referring to FIG. 8, an electric connector according to the third embodiment of the present invention uses probe pins each comprising a movable bifurcate contact piece 2*a* and a stationary bifurcate contact piece 2*b*. The movable bifurcate contact piece 2*a* comprises a front projection having two opposite diverging arms extending rearward and having tapered inner sides 2*f* and 2*g* whereas a stationary bifurcate piece 2*b* having two opposite converging arms 2*c* and 2*c* extending forward from its base 2*d*. The diverging arms of the movable contact piece 2*a* embrace the converging arms 2*c* and 2*c* of the stationary contact piece 2*b*. Specifically when the movable bifurcate contact piece 2*a* is depressed, the diverging arms of the movable contact piece 2*a* bend the contact ends 2*n* of the converging arms 2*c* of the stationary bifurcate contact piece 2*b* inward, so that the converging arms 2*c* may avail themselves of the repulsive force thus caused to make a reliable electric connection between the movable and stationary contact pieces 2*a* and 2*b*. These converging arms 2*c* abut against the base 2*r* of the movable contact piece 2*a* to prevent the movable contact piece 2*a* from invading too deep in the pin slot 1*b*.

Figure 9:
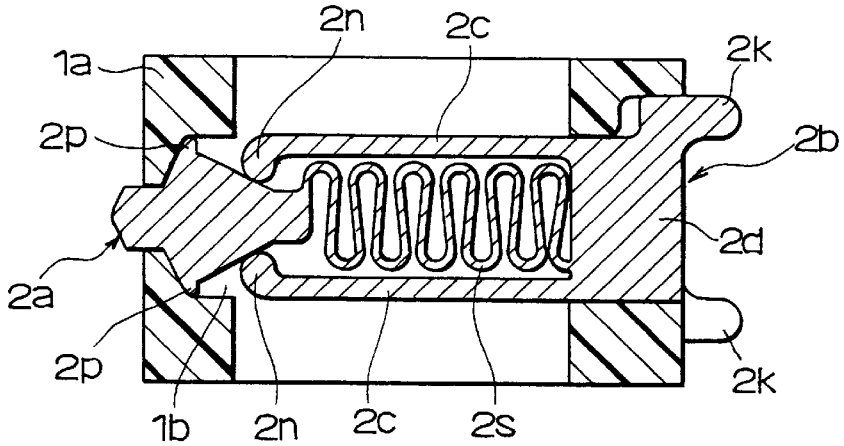
FIG. 9 shows, in section, an electric connector according to a fourth embodiment.
Figure 10:
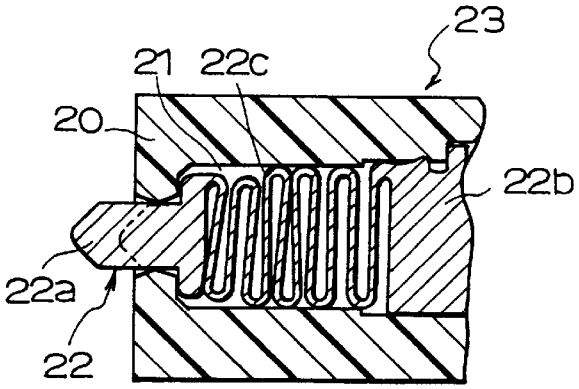
FIG. 10 PRIOR ART
FIG. 10 shows, in section, a conventional depressible type of electric connector.
Figure 11:
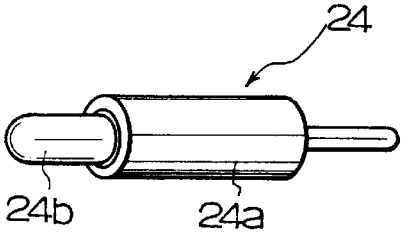
FIG. 11 PRIOR ART
FIG. 11 is a perspective view of another conventional depressible type of electric connector.

Referring to FIG. 9, an electric connector according to the fourth embodiment of the present invention uses probe pins each comprising a movable contact piece 2*a* and a stationary bifurcate contact piece 2*b* whose base 2*d* is integrally connected to the movable contact piece 2*a* via spring suspension means 2*s*. The spring suspension means 2*s* is a zigzag spring to apply a resilient push to the movable contact piece 2*a*. The movable bifurcate contact piece 2*a* has shoulders 2*p* formed at its front projection-to-rear convergence transitions, thereby providing detent means for catching the contact ends 2*n* and 2*n* of the opposite arms 2*c* and 2*c* of the stationary contact piece 2*b*, thereby preventing the movable contact piece 2*a* from being depressed deep too much in the pin slot 1*b*. The parallel-arrangement of three current-carrying passages (i.e. the two opposite arms 2*c* plus the intermediate suspension 2*s*) has the effect of significantly increasing the current-conducting capacity in comparison with the first, second and third embodiments.

When the male and female connectors are separated in the first to fourth embodiments, the movable contact pieces 2*a* of the female connector 1 are allowed to move forward under the resilient influence provided by the opposite arms 2*c* or resilient spring 2*s* of the stationary contact piece.

As may be understood from the above, an electric connector according to the present invention uses probe pins which are simple in structure, and can be easily fabricated by stamping them from thin metal sheets. The bifurcate stationary contact piece can function as wiper, also. The dual or triple parallel-arrangement of current-carrying passages has the effect of significantly increasing the current conducting capacity of the electric connector.

Each probe pin has detent means for preventing the movable contact piece from being depressed deep too much in the pin slot.

What is claimed is:

1. An electric connector comprising an insulating casing having a plurality of contact pin slots made therein and a corresponding plurality of probe pins inserted in the contact pin slots of the insulating casing, wherein each of the probe pins comprising a movable contact piece having a front projection and a rear portion provided with tapered surfaces integrally connected to the front projection; and a stationary bifurcate contact piece fixedly connected to the insulating casing and having two contact arms extending from its base, wherein when the front projection of each probe pin appearing from the contact pin slot is pushed against a selected counter contact, the front projection of the probe pin is withdrawn in the contact pin slot to allow the rear portion of the movable contact piece to slide on distal ends of the two arms of the stationary bifurcate contact piece by bending the opposite arms yieldingly inward or outward; and means disposed within each contact pin slot and operative in conjunction with the stationary bifurcate contact piece and the insulating casing for stopping respective ones of the probe pins from penetrating corresponding ones of the contact pin slots beyond a certain limit.

2. An electric connector according to claim 1 wherein the stopping means includes a detent extension projecting from the base of the stationary bifurcate contact piece for preventing sliding of the rear portion beyond the certain limit.

3. An electric connector according to claim 1 wherein the rear convergence of the movable contact piece is integrally connected to the base of the stationary bifurcate contact piece by a resilient member.

4. An electric connector according to claim 1, wherein each contact pin slot forms a stepped-down aperture with a small aperture portion and a large aperture portion, the front projection being slidably engaged with the small aperture portion and the rear portion being slidably engaged with the large aperture portion such that the probe pin moves within the stepped-down aperture in a manner that prevents the probe pin from exiting the insulating casing through the small aperture portion.

5. An electric connector according to claim 4, wherein when the stopping means stops the probe pin from penetrating the contact pin slot beyond the certain limit, the front projection remains in slidable engagement with the small aperture portion.

6. An electric connector according to claim 5, wherein when the stopping means stops the probe pin from penetrating the contact pin slot beyond the certain limit, the rear portion remains in slidable engagement with the large aperture portion.

7. An electric connector according to claim 1, wherein each probe pin is slidably engaged in a close fitting relationship with a respective one of the contact pin slots for rectilinear movement by the probe pin within the contact pin slot.

* * * * *